US005188184A

United States Patent [19]

Northill

[11] Patent Number: 5,188,184

[45] Date of Patent: Feb. 23, 1993

[54] FIRE SUPPRESSION SYSTEMS

[75] Inventor: Barry W. Northill, New South Wales 2830, Australia

[73] Assignee: Noelene M. Northill, Dubbo, Australia; a part interest

[21] Appl. No.: 763,658

[22] Filed: Sep. 18, 1991

[30] Foreign Application Priority Data

Sep. 18, 1990 [AU] Australia ..... PK2359

[51] Int. Cl.[5] ..... A62C 37/36; A62C 37/00; A62C 35/00

[52] U.S. Cl. ..... 169/22; 169/20

[58] Field of Search ..... 169/17, 19, 22, 20, 169/18, 57

[56] References Cited

U.S. PATENT DOCUMENTS

| | | | |
|---|---|---|---|
| 357,987 | 2/1887 | Gray | 169/20 |
| 392,250 | 11/1888 | Wyman | 169/20 |
| 392,251 | 11/1888 | Wyman | 169/20 |
| 425,752 | 4/1890 | Clapp | 169/20 |
| 1,206,485 | 11/1916 | Tague | 169/20 |
| 3,100,017 | 8/1963 | Johnson | 169/19 X |
| 4,194,572 | 3/1980 | Thery et al. | 169/17 X |
| 4,220,208 | 9/1980 | Jackson et al. | 169/17 |

FOREIGN PATENT DOCUMENTS

| | | | |
|---|---|---|---|
| 209388 | 1/1987 | European Pat. Off. | 169/17 |
| 301475 | 10/1932 | Italy | 169/17 |
| 24160 | of 1893 | United Kingdom | 169/22 |
| 219871 | 8/1924 | United Kingdom . | |
| 1077353 | 7/1967 | United Kingdom | 169/17 |

*Primary Examiner*—Charles A. Marmor

*Assistant Examiner*—James M. Kannofsky

*Attorney, Agent, or Firm*—Ladas & Parry

[57] ABSTRACT

A fire suppression system in which fire suppressant material is contained in a reservoir, the reservoir having an outlet and a system containing one or more nozzles from which the suppressant is delivered for fire suppresant purposes.

The system incorporates a valve between the reservoir outlet and the nozzle(s) the valve including a movable valve member and a valve seat which cooperates with the movable member. The valve member is movable from a closed position with respect to the valve seat preventing communication of suppressant between the reservoir and the nozzle(s) to an open position permitting flow of the suppressant from the reservoir to the nozzle(s).

An actuator is provided to selectively open and close the aforesaid valve member. The actuator maintains a fluid (preferably nitrogen) under pressure to maintain the valve member in the closed position and is operable to vent the fluid to lower the pressure in the valve, thus permitting the valve member to open. A coupling arrangement joins the reservoir outlet to the valve such that suppressant under pressure is conducted from the reservoir through the coupling member. A check valve is located between the duct through which fluid is conducted from the actuator into the system and the coupling device through which suppressant is conducted from the reservoir into the system. This check valve prevents flow from the coupling device in a reverse direction towards the actuator.

9 Claims, 4 Drawing Sheets

FIRE SUPPRESSION SYSTEMS

TECHNICAL FIELD

This invention relates to fire suppression systems and more particularly to such systems as are useful in underground locations such as mines and also in the protection of heavy earth moving equipment where engines can cost between $A500,000 and $A1,000,000 and braking systems are also in need of protection against fire.

BACKGROUND OF THE INVENTION

Conventional such fire suppression systems incorporate a cylinder containing fire suppressant foam under pressure with an actuator head in physical contact with the cylinder and a pneumatic actuator to activate the actuator head when use of the pressurised foam for fire suppressant purposes is required. The system also utilizes a series of heat sensitive sensors in the region where fire suppression may be required, which region may be somewhat removed from the location of the cylinder and actuator. This conventional system has proven, in some circumstances, to be very dangerous. Physical interference with the actuator head has resulted in severe injuries to people engaged in that activity. In any event, a 3 to 5% failure rate of installed equipment has arisen, since fine adjustments necessary in the actuator head have proven too critical. Obviously such a system which fails to operate in a fire situation is highly undesirable. A further problem which has arisen with this conventional fire suppression system is that the pneumatic actuator may be activated by local heat, leading to the spraying of foam in a remote area where no fire is evident.

OBJECT OF THE INVENTION

It is an object of this invention to provide an improved fire suppression system.

SUMMARY OF THE INVENTION

This invention in one broad form provides a fire suppression system comprising a reservoir to contain a fire suppressant material, said reservoir having an outlet, at least one nozzle from which the suppressant is delivered;

a valve joining the reservoir outlet and said nozzle, said valve including a movable valve member and a seat cooperating therewith, said valve member being movable from a closed position with respect to said seat preventing communication between said reservoir and said nozzle, and an open position permitting the flow of said material from said reservoir to said nozzle;

an actuator operatively associated with said valve to selectively cause movement of said valve member from said closed position to said open position, and wherein said actuator maintains a fluid under pressure to maintain said valve member in said closed position, said actuator being operable to vent said fluid to lower the pressure therein and permitting said valve member to move to said open position.

BRIEF DESCRIPTION OF THE DRAWINGS

A preferred form of the present invention will now be described by way of example with reference to the accompanying drawings wherein.

Figure 1:
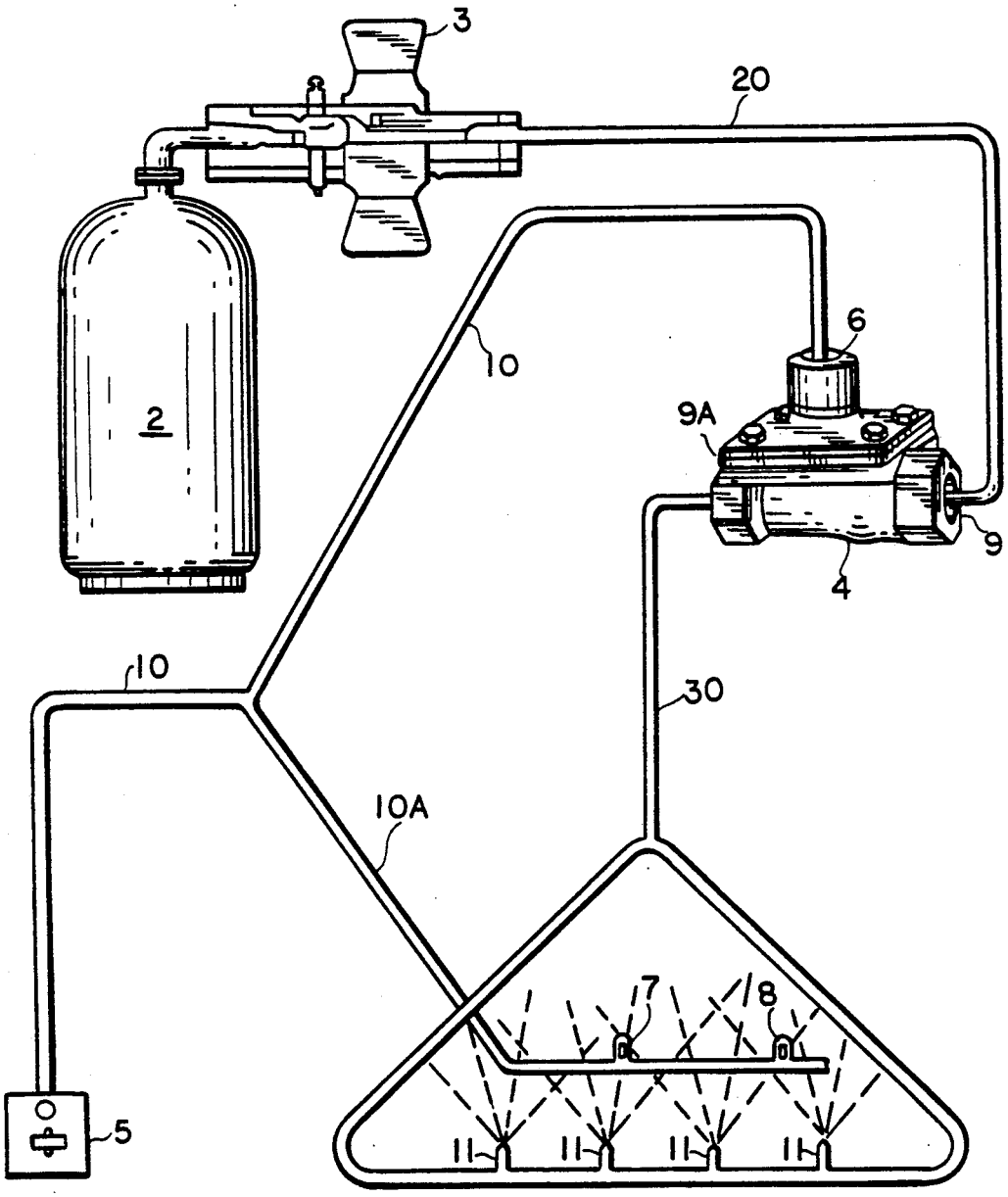
FIG. 1 is a schematic illustration of a fire suppression system for heavy earth working equipment.

Line 20 is connected between foam agent tank 2 via conventional hydraulic coupling 3 to one side 9 of diaphragm valve 4. The function of hydraulic coupling 3 is to remove agent from tank 2.

Line 10 is connected between manually operable actuator unit 5 and the top 6 of diaphragm valve 4. A branch 10A of line 10 extends to sensors in the form of sprinkler bulbs 7, 8.

Line 30 extends from the second side 9A of diaphragm valve 4 to spray nozzles 11.

In operation, line 10 is first charged with nitrogen to close the moving member (not shown) of diaphragm valve 4. Line 20 is then charged with nitrogen up to the closed moving member of diaphragm valve 4.

When heat occasions actuation of sprinkler bulbs 7, 8, the pressure in line 10, 10A is reduced, thus opening diaphragm valve 4 whereby foam agent from tank 2 is directed through line 30 to exit through spray nozzles 11.

Manual operation of the unit can be effected through the actuator unit 5, thus releasing pressure from valve 4 whereby foam agent from tank 2 is directed through line 30 to exit through spray nozzles 11.

The system of this invention therefore provides an arrangement which involves a minimum number of parts with no necessity to manually adjust pressure in the foam agent tank. The system is simple and effective and far more safe than conventional such systems.

Figure 2:
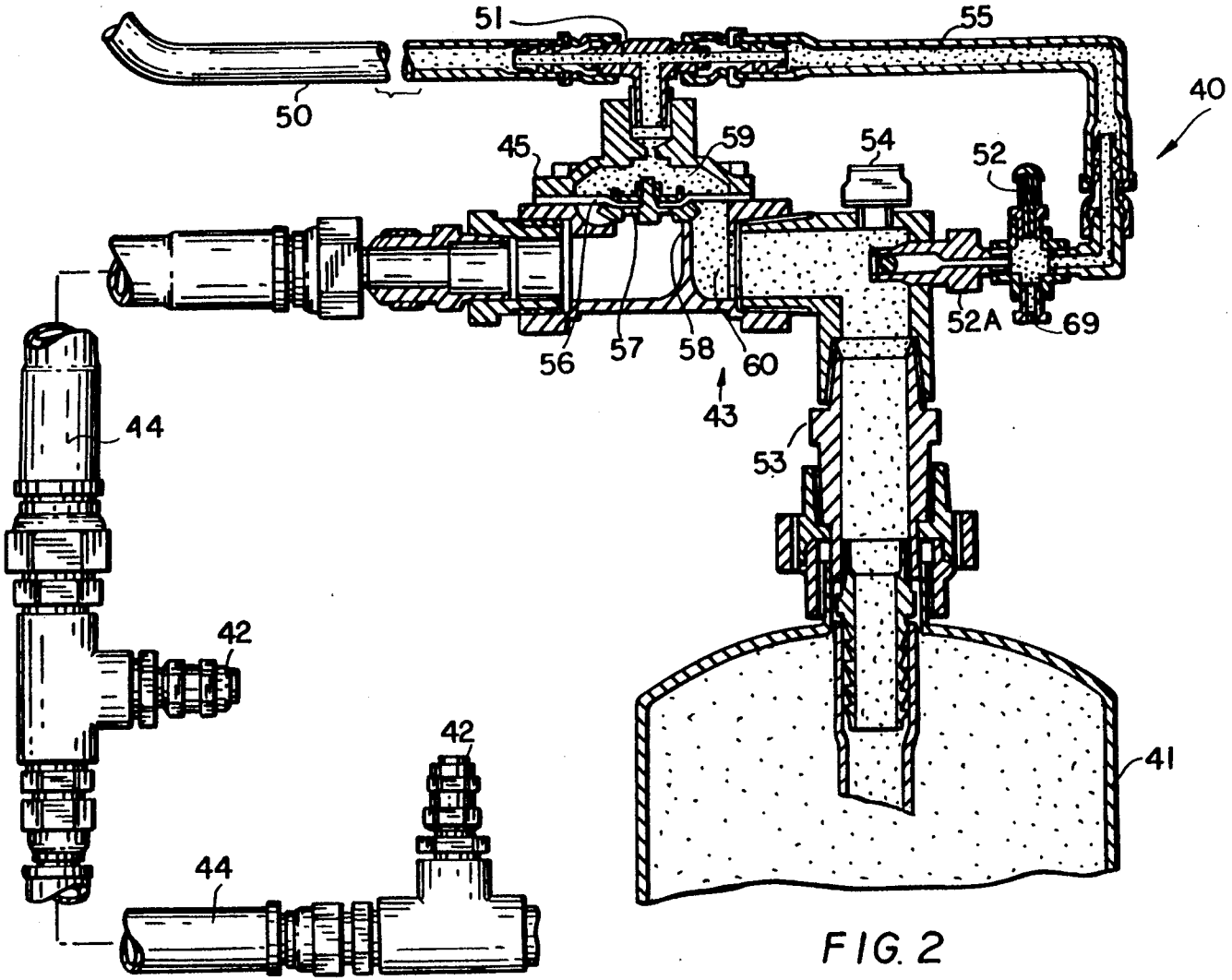
FIGS. 2 to 4 are schematic illustrations of a modification of the system of FIG. 1, with FIG. 2 illustrating portion of the system in a charged configuration, and FIG. 4 illustrating the same system when activated.
Figure 3:
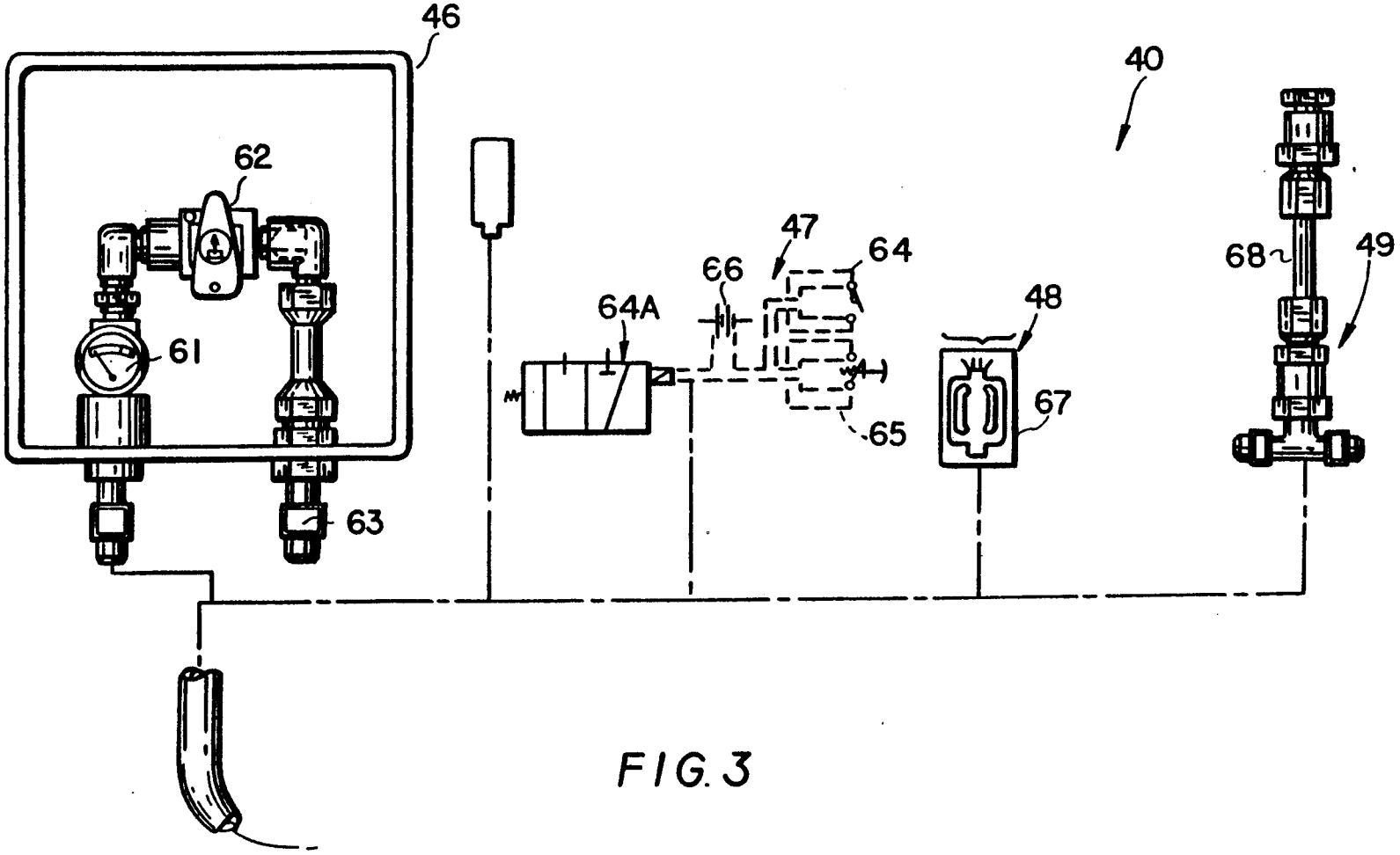
Figure 4:
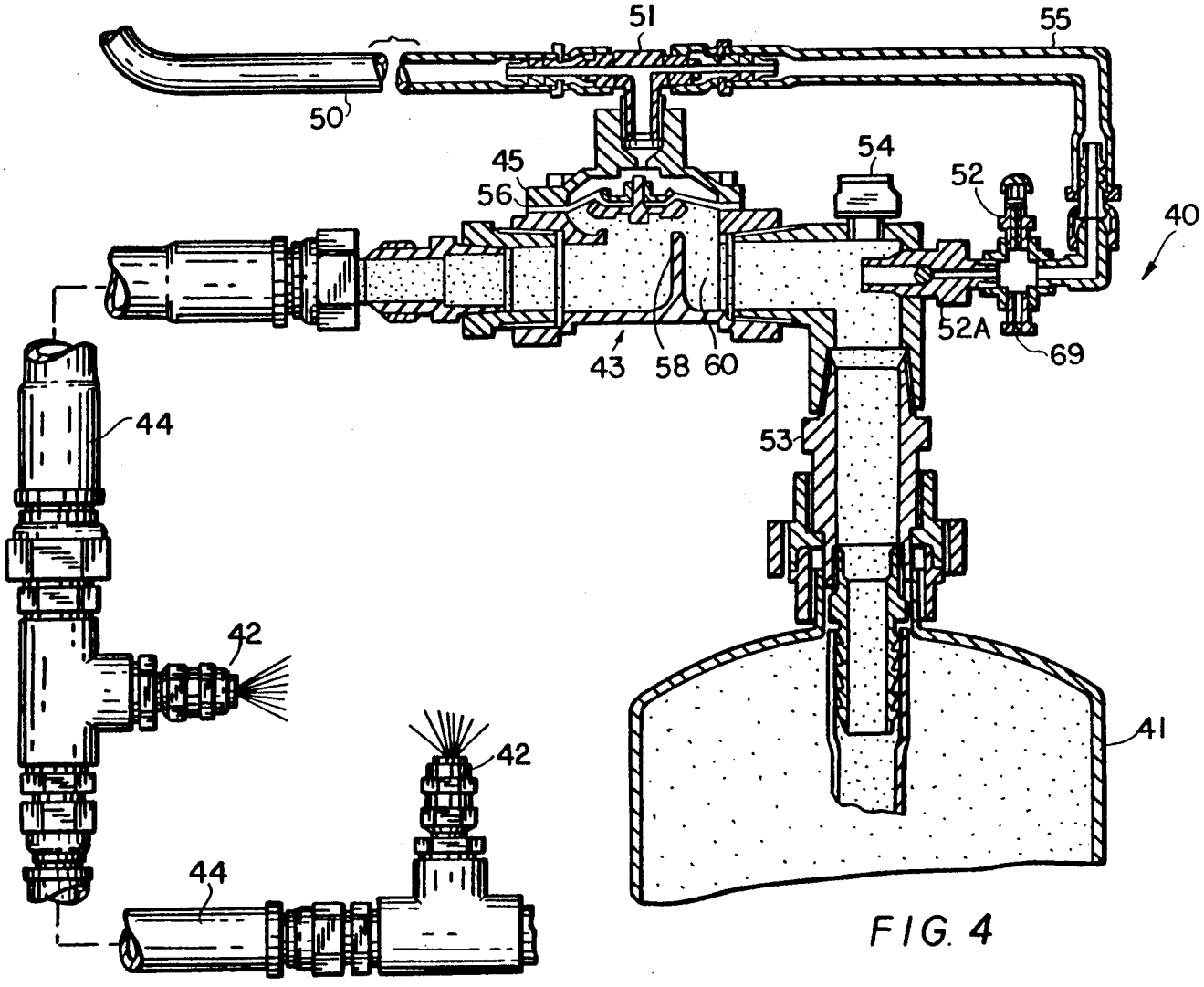

In FIGS. 2 to 4, there is schematically depicted a heavy vehicle fire suppression system 40. The system 40 includes a cylinder 41 containing an agent to be delivered to nozzles 42 in the case of fire. Passage of the agent to the nozzles 42 is governed via a valve assembly 43, with the valve assembly 43 being connected to the nozzles 42 by means of a conduit 44. The valve assembly 43 includes, in this preferred embodiment, a diaphragm valve 45. However it should be appreciated that other valve assemblies may be employed such as a piston or spool valve. The valve assembly 43 is in turn controlled by any one or combination of actuators 46 to 49. One or more of the actuators 46 to 49 is connected to the diaphragm valve 45 by means of a conduit 50, engaging a T-junction 51. The T-junction apart from connecting the conduit 50 and diaphragm 45, is attached to a charging valve 52, and a check valve 52A.

The cylinder 41, check valve 52A and diaphragm valve 45 are joined by a connection assembly 53, upon which there is also mounted a content gauge 54.

Once the system 40 has been assembled, the system upstream of the diaphragm 45 is charged with nitrogen. That is any one or more of the actuators 46 to 49, the conduits 50 and 55, the connection assembly 53 and the upstream portion of the diaphragm valve 45. The pressure applied to the diaphragm 56 by the nitrogen under pressure, maintains the movable valve member 57, of the diaphragm valve 45, sealingly in contact with the annular valve seat 58.

The actuators 46 to 49 are provided to selectively vent the nitrogen to atmosphere. When the nitrogen is vented to atmosphere, the pressure in the chamber 59 is lowered permitting the diaphragm 56 to be deflected from the position shown in FIG. 2, to the position shown in FIG. 4. This is achieved by the pressure maintained within the annular cavity 60 on the other side of the diaphragm 56. In this regard it should be appreciated that the check valve 52A prevents pressure escaping in a reverse direction from the connection assembly 53 to the conduit 55.

Once the movable valve member 57 has been unseated with respect to its seat 58, the agent from the cylinder 41 flows to the nozzles 42, as illustrated in FIG. 4.

The actuator 46 is manually operated and includes a gauge 61 to provide an indication of the pressure of the nitrogen in the system 40. Downstream of the gauge 61 is a manually operated valve 62 which connects to an outlet 63. The operator by manipulation of the valve 62, vents the nitrogen to atmosphere via the outlet 63.

The actuator 47 includes a solenoid spool valve 64A which is operated by one of two switches 64, 65. The switches 64 and 65 electrically connect the valve 64A to an electric supply (battery) 66. For example, the switch 65 could be palm operated and the switch 64 foot operated. Solenoid spool valve 64A in the closed position retains the fluid (nitrogen) pressure in chamber 59, which in turn holds diaphragm valve 45 in the closed position. When solenoid spool valve 64A is in the open position, fluid (nitrogen) from chamber 59 is vented, allowing diaphragm valve 45 to open, thus allowing suppressant from tank 41 to be expelled through nozzles 42.

The actuator 48 is one or more bulb type sprinklers 67. Upon heat being applied to the bulb, the bulb fractures, venting the nitrogen to atmosphere.

The actuator 49 includes a polypropylene tube 68 which if subjected to fire melts and vents the nitrogen to atmosphere.

The nitrogen charging nipple 52 includes a fusible link 69 which melts at a predetermined temperature. Accordingly if the area in the vicinity of the nipple 52 is subjected to fire, the fusible link 69 will melt venting the nitrogen to atmosphere. Accordingly the system 10 is then activated.

I claim:

1. A fire suppression system comprising a reservoir to contain a fire suppressant material, said reservoir having an outlet, at least one nozzle from which the suppressant is delivered;

a valve joining the reservoir outlet and said at least one nozzle, said valve including a movable valve member and a seat cooperating therewith, said valve member being movable from a closed position with respect to said seat preventing communication between said reservoir and said at least one nozzle, to an open position permitting the flow of said material from said reservoir to said at least one nozzle;

an actuator operatively associated with said valve to selectively cause movement of said valve member from said closed position to said open position, and wherein said actuator maintains a fluid under pressure to maintain said valve member in said closed position, said actuator being operable to vent said fluid to lower the pressure therein and permitting said valve member to move to said open position, said valve being a diaphragm valve having a diaphragm member operatively associated with said seat, one side of said diaphragm member being exposed to said fluid under pressure to maintain the diaphragm valve in a closed position with respect to said seat, the other side of said diaphragm member being partly exposed to said fluid under pressure, coupling means joining said reservoir outlet with said valve, and duct means joining said coupling with said actuator so that said coupling receives said fluid under pressure, and a check valve disposed between said duct means and said coupling means preventing flow from said coupling means in a reverse direction towards said actuator.

2. The system of claim 1 further including a fluid charging means to deliver the fluid under pressure to a position adjacent said check valve so that said fluid under pressure passes through said check valve to said coupling means.

3. The system of claim 2 wherein said fluid charging means includes a fusible link adapted to melt at a predetermined temperature to vent said fluid to atmosphere, thereby permitting evacuation of said suppressant from said reservoir via said at least one nozzle.

4. The system of claim 3 wherein said actuator includes a manually operable valve.

5. The system of claim 3 wherein said actuator is a solenoid valve having a closed and an open position, with said solenoid valve in said open position permitting said fluid to be vented to atmosphere.

6. The system of claim 3 wherein said actuator is a bulb type sprinkler.

7. The system of claim 3 wherein said fluid is nitrogen.

8. The system of claim 3 wherein said actuator includes a closure member which melts at a predetermined temperature, to vent said fluid to atmosphere.

9. The system of claim 8 wherein said closure member is a tube of plastics material.

* * * * *